US010675529B1

(12) United States Patent
Lumia et al.

(10) Patent No.: US 10,675,529 B1
(45) Date of Patent: Jun. 9, 2020

(54) TABLETOP GAME

(71) Applicant: We Play Change LLC, Glenham, NY (US)

(72) Inventors: David Lumia, Hyde Park, NY (US); Nicholas DeMarco, Fishkill, NY (US); Brendan Davis, Poughkeepsie, NY (US)

(73) Assignee: We Play Change LLC, Glenham, NY (US)

( * ) Notice: Subject to any disclaimer, the term of this patent is extended or adjusted under 35 U.S.C. 154(b) by 0 days.

(21) Appl. No.: 16/395,512

(22) Filed: Apr. 26, 2019

Related U.S. Application Data

(60) Provisional application No. 62/805,336, filed on Feb. 14, 2019.

(51) Int. Cl.
*A63B 67/06* (2006.01)
*A63F 3/00* (2006.01)

(52) U.S. Cl.
CPC ..... *A63F 3/00261* (2013.01); *A63F 3/0023* (2013.01); *A63F 3/00697* (2013.01); *A63F 2003/00378* (2013.01); *A63F 2003/00703* (2013.01)

(58) Field of Classification Search
CPC ..... A63F 3/00261; A63F 3/00697; A63F 3/0023; A63F 2003/00703; A63F 2003/00378
USPC ..... 273/342, 287, 282.1; 312/257.1, 260, 312/263, 264; 144/144.52
See application file for complete search history.

(56) References Cited

U.S. PATENT DOCUMENTS 2,112,498 A * 3/1938 Lax ..... A47B 45/00 312/352
3,379,483 A * 4/1968 Oldford ..... A47B 47/042 312/263
5,056,796 A * 10/1991 Conville ..... A63B 67/06 273/402
5,215,205 A * 6/1993 Behlman ..... B60R 7/02 220/4.31
5,765,832 A * 6/1998 Huff ..... A63B 63/08 273/354
5,871,216 A * 2/1999 Sparacino ..... A63B 63/08 273/402
6,244,598 B1 * 6/2001 Conville ..... A63B 63/00 273/402
8,807,569 B1 * 8/2014 Davis ..... A63B 67/06 273/371
9,033,760 B2 * 5/2015 Filip ..... A63H 33/42 273/283
2011/0266744 A1 11/2011 Martinez et al.
(Continued)

OTHER PUBLICATIONS

Coinhole—The Quarter Bouncing Board Game, pp. 1-18, found Nov. 19, 2018, https://www.coinhole.com.

*Primary Examiner* — Vishu K Mendiratta
(74) *Attorney, Agent, or Firm* — Saile Ackerman LLC; Stephen B. Ackerman; Rosemary L. S. Pike

(57) ABSTRACT

A re-configurable game board set can be used to play a variety of games in a variety of configurations and can be compacted for easy storage or transportation. The game board set can be of a size to easily fit on a tabletop and can use coins or similar tokens as playing pieces. Alternatively, the game board set could be larger to be played with larger playing pieces such as beanbags, balls, or discs. Games can be played with or without launching pads.

15 Claims, 5 Drawing Sheets

(56) References Cited

U.S. PATENT DOCUMENTS

| | | | | |
|---|---|---|---|---|
| 2014/0252718 | A1* | 9/2014 | Rieman | A63B 67/007 273/342 |
| 2015/0231465 | A1 | 8/2015 | Kelly | |
| 2018/0043227 | A1* | 2/2018 | Segerstrom | A63F 9/0204 |

* cited by examiner

TABLETOP GAME

This application claims benefit of U.S. Provisional application Ser. No. 62/805,336, filed on Feb. 14, 2019, and herein incorporated by reference in its entirety.

(1) TECHNICAL FIELD

The disclosure relates to games, and more particularly, to a tabletop game played with coins.

(2) BACKGROUND

There are currently games that are smaller versions of the popular backyard game of corn hole in which players utilize coins to shoot at a target. U.S. Patent Application 2015/0231465 (Kelly) discloses a game board for playing the Quarters drinking game.

SUMMARY

A principal object of the present disclosure is to provide a game board for a game using coins.

Another object of the disclosure is to provide a game board for a game using coins wherein the game board can be reconfigured to play a variety of games.

Another object of the disclosure is to provide a game board for a game using coins including a surface for bouncing coins.

A further object is to provide a game board for a game wherein objects are aimed to pass through holes wherein the game board can be reconfigured to play a variety of games.

In accordance with the objects of the disclosure, a re-configurable game board for is provided. The game board comprises two outer boards having a first length, a first width, and a first thickness wherein the first length is greater than the first width, wherein at least one first circular hole is formed through inner and outer surfaces of each of the outer boards, wherein male interlocking joints are formed along both ends of the two outer boards in a direction of the first width, and wherein two female interlocking joints are formed in the inner surface of each of the two outer boards near both ends of the two outer boards in the width direction. An inner board has a second length less than the first length, a second width equal to the first width, and a second thickness equal to the first thickness, wherein at least one second circular hole is formed through inner and outer surfaces of the inner board, and wherein male interlocking joints are formed along both ends of the inner board in a direction of the second width. Two change pieces have a third length equal to the first width, a third width smaller than the first width, and a third thickness equal to the first thickness, wherein male interlocking joints are formed along both ends of the two change pieces in a direction of the third length, and wherein a female interlocking joint is formed in an inner surface of each of the two change pieces in a direction of the third length and centrally located with respect to a direction of the third width. Two launching pads have a fourth length less than the second length, a fourth width equal to the first width, and a fourth thickness.

Also in accordance with the objects of the disclosure, a method for playing a game is achieved. A re-configurable game board is provided, comprising two outer boards having a first length, a first width, and a first thickness wherein the first length is greater than the first width, wherein at least one first circular hole is formed through inner and outer surfaces of each of the outer boards, wherein male interlocking joints are formed along both ends of the two outer boards in a direction of the first width, and wherein two female interlocking joints are formed in the inner surface of each of the two outer boards near both ends of the two outer boards in the first width direction. An inner board has a second length less than the first length, a second width equal to the first width, and a second thickness equal to the first thickness, wherein at least one second circular hole is formed through inner and outer surfaces of the inner board, and wherein male interlocking joints are formed along both ends of the inner board in a direction of the second width. Two change pieces have a third length equal to the first width, a third width smaller than the first width, and a third thickness equal to the first thickness, wherein male interlocking joints are formed along both ends of the two change pieces in a direction of the third length, and wherein a female interlocking joint is formed in an inner surface of each of the two change pieces in a direction of the third length and centrally located with respect to a direction of the third width. Two launching pads have a fourth length less than the second length, a fourth width equal to the first width, and a fourth thickness. To play, assemble the game board into a desired shape by interlocking some of the interlocking joints, position at least one of the two launching pads at one side of the assembled game board, and release a playing piece onto the at least one launching pad, aiming the playing piece for one of the first or second circular holes, wherein the playing piece bounces on the at least one launching pad.

Also in accordance with the objects of the disclosure, a method for fabricating a re-configurable game board is achieved. Two outer boards are fabricated having a first length, a first width, and a first thickness wherein the first length is greater than the first width. At least one first circular hole is cut through inner and outer surfaces of each of the outer boards. Male interlocking joints are cut along both ends of the two outer boards in a direction of the first width. Two female interlocking joints are cut in the inner surface of each of the two outer boards near both ends of the two outer boards in the first width direction. An inner board is fabricated having a second length less than the first length, a second width equal to the first width, and a second thickness equal to the first thickness. At least one second circular hole is cut through inner and outer surfaces of the inner board. Male interlocking joints are cut along both ends of the inner board in a direction of the second width. Two change pieces are fabricated having a third length equal to the first width, a third width smaller than the first width, and a third thickness equal to the first thickness. Male interlocking joints are cut along both ends of the two change pieces in a direction of the third length. A female interlocking joint is cut in an inner surface of each of the two change pieces in a direction of the third length and centrally located with respect to a direction of the third width. Two launching pads are fabricated having a fourth length less than the second length, a fourth width equal to the first width, and a fourth thickness.

BRIEF DESCRIPTION OF THE DRAWINGS

In the accompanying drawings forming a material part of this description, there is shown.

DETAILED DESCRIPTION

The present disclosure provides a game board for a coin launching game similar to the outdoor game of corn hole. The game board consists of pieces utilizing sliding or interlocking joints that fit together to form multiple games. The pieces slide together to form a compact package for storage or when not in use. The game board of the present disclosure has the ability to convert into multiple quarter/coin based games. The game board also includes a pad on which players can bounce coins on any surface.

The game set of the present disclosure is a convertible coin based game. The game board is configured to be used indoors such as on a tabletop, but the game board can be used on any surface, indoors or outdoors. It can be converted into multiple configurations which allow players the ability to play different games. The game set includes up to seven preferably rectangular pieces made out of wood or laminate, for example. Alternatively, the game board pieces could be made from plastic, resin, or rubber, for example.

FIGS. 1A-1G illustrate the individual pieces of the game set of the present disclosure. The use of 'length' and 'width' are somewhat arbitrary, but those terms will be used throughout the disclosure to refer to the dimensions as illustrated in FIGS. 1A-1G where the length is the longest dimension. Each rectangular piece has a length L longer than a width W and a thickness Th much smaller than the width. For example, the length could be 4" to 12", the width could be 4" to 8", and the thickness could be 0.75" to 1.5". These sizes are appropriate for an indoor tabletop game, for example. It is anticipated that a larger version of the game board could used with balls, bags, such as beanbags or hacky sacks, or discs, for example, instead of coins. Thus, length, width, and thickness dimensions could be any appropriate size larger than the examples given. Reference is made below to inner and outer faces of the game board pieces. The outer faces are defined to be those faces of the game board pieces showing when the game board set is arranged for storage, as shown in FIG. 2. The inner faces are opposite to the outer faces and do not show when the game board set is arranged for storage.

Figure 1A:
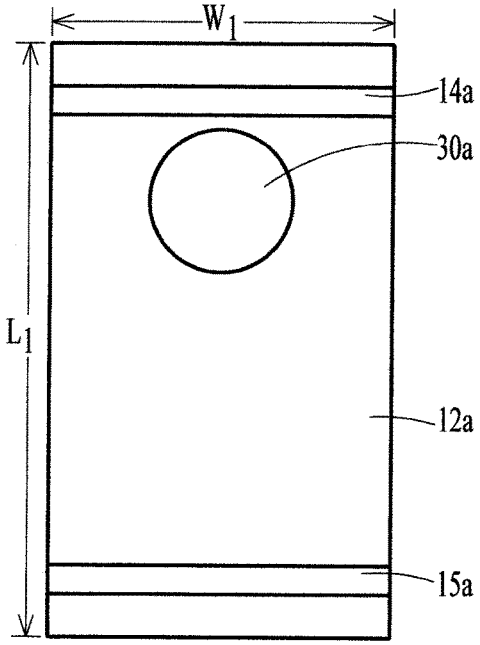
FIGS. 1A-1G illustrate the individual pieces of the game board of the present disclosure.
Figure 1B:
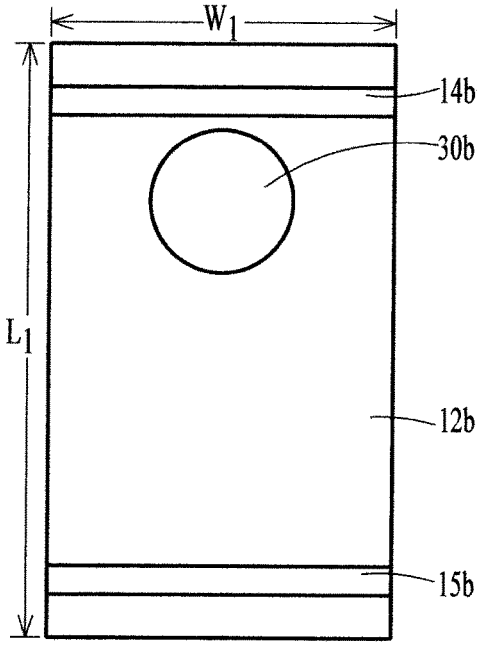
Figure 2:
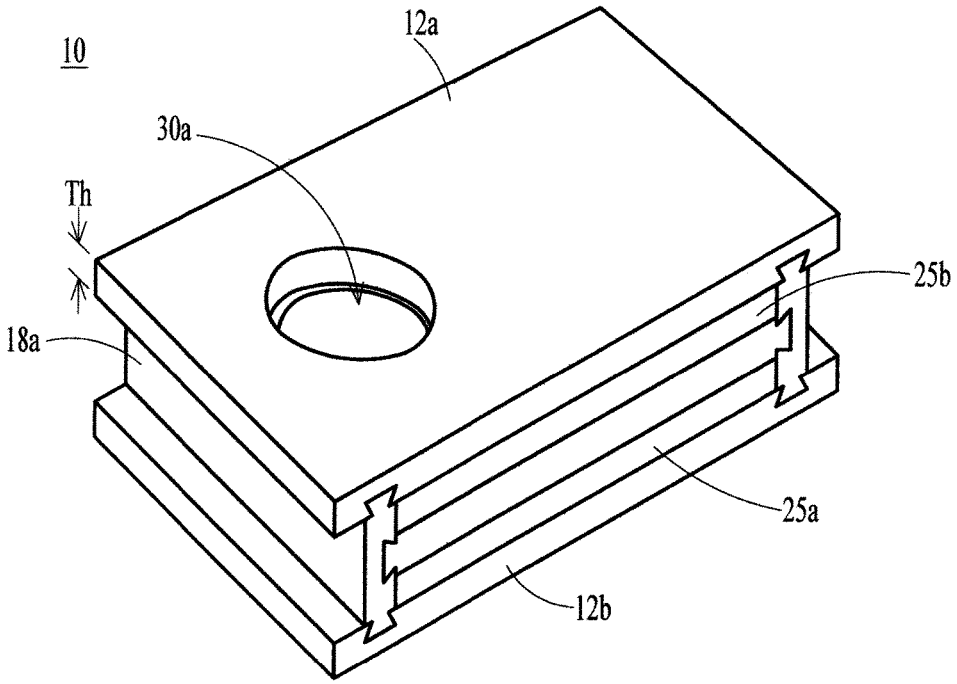
FIG. 2 illustrates the game board of the present disclosure arranged for storage.
Figure 3:
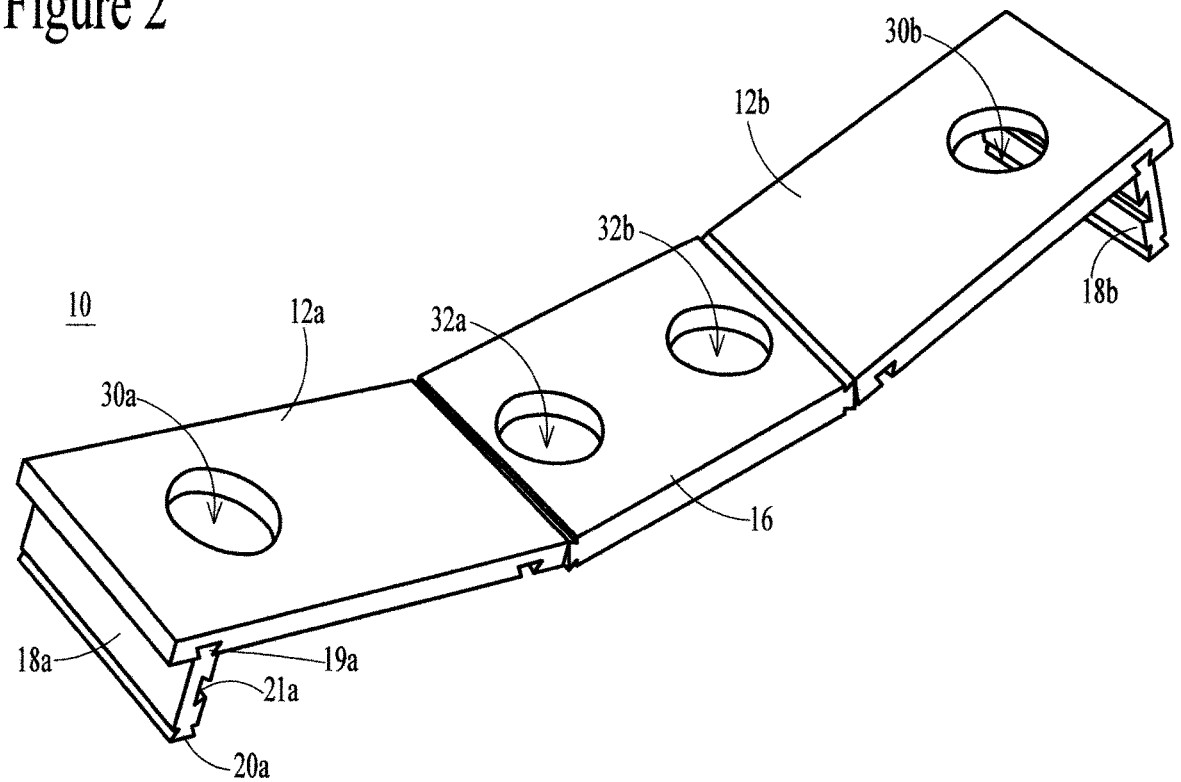
FIGS. 3-6 illustrate various arrangements of the game board of the present disclosure.

Referring now to FIGS. 1A and 1B, two outer game board pieces 12*a* and 12*b*, respectively, are illustrated. The rectangular plane of an outer face of the two outer pieces 12*a* and 12*b* can be thought of as being divided into two halves vertically. In each of the two outer pieces 12*a* and 12*b*, preferably one hole 30*a* has been made through the center, in the width $W_1$ direction, of the top half of a face of the rectangular plane. The circular hole 30*a* has a diameter large enough so that a coin such as a quarter or other game piece such as a token or chip, for example, can fit through the hole. In the case where a much larger game piece is used, such as a disc, ball, or beanbag, for example, the diameter of the hole is large enough for the larger game piece to pass through. Alternatively, more than one hole could be made through the outer game boards 12*a* and 12*b* and the hole or holes could be oriented in the outer face in any way desired.

Figure 5:
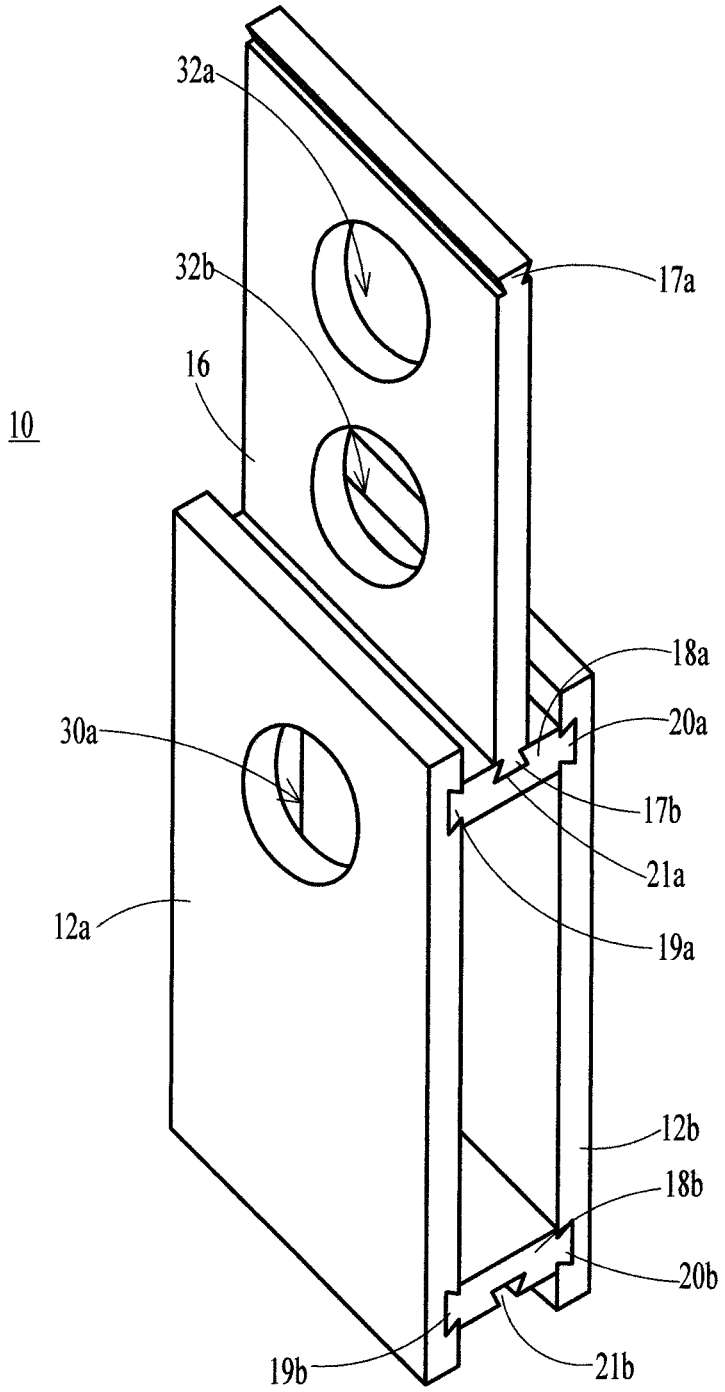

As can be seen more clearly in FIG. 5, female interlocking joints are routed out from the inner face near the two edges of the outer boards 12*a* and 12*b* near each shorter side. Outer board 12*a* has female interlocking joints 14*a* and 15*a* in the form of slots running across the width $W_1$ of the boards near the two shorter ends. For example, the slots 14*a* and 15*a* may be in the top and bottom ¼ of the inner face of the outer board 12*a*. Likewise, female interlocking joints 14*b* and 15*b* are made in the top and bottom ¼ of the inner face of the outer board 12*b*. Hole 30*b* is formed in the same way through the outer board 12*b*. The slots 14*a*, 15*a*, 14*b*, and 15*b* extend from the bottom surface no more than half way through the thickness Th of the outer boards 12*a* and 12*b*, respectively. For example, the interlocking joints could be dovetail joints or sliding joints or another type of interlocking joints.

Figure 1D:
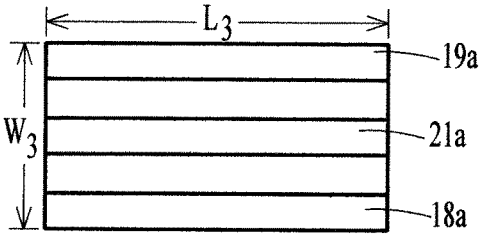
Figure 1E:
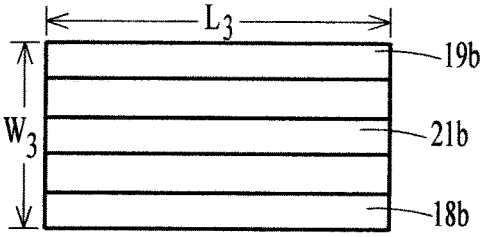
Figure 1C:
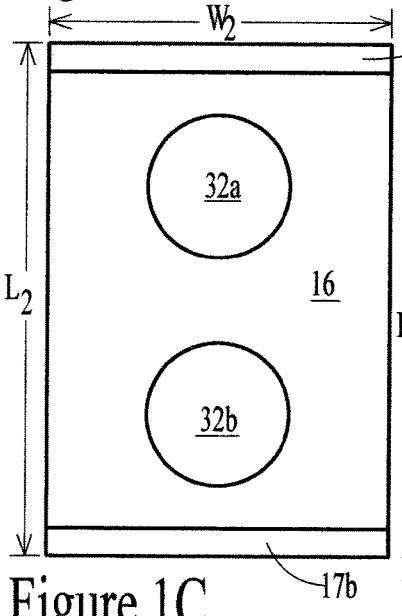

The inner board 16, shown in FIG. 1C, has preferably the same width and thickness as the outer boards 12*a* and 12*b*, but has a shorter length than that of the outer boards. That is, width $W_2=W_1$ and $L_2<L_1$. The inner board has preferably two holes 32*a* and 32*b* centrally located in the width direction and preferably evenly spaced between the two short ends of the outer face of the inner board and preferably evenly spaced from each other in the length direction. Alternatively, only one hole or more than two holes may be made in inner board 16. Each of the short ends of the inner board 16 is shaped into a male interlocking joint 17*a* and 17*b*, seen more clearly in FIG. 4.

The change pieces 18*a* and 18*b*, shown in FIGS. 1D and 1E, respectively, are identical to each other and have lengths $L_3$ preferably equal to the widths $W_2$ and $W_1$ of the inner and outer boards, 16 and 12*a* and 12*b*, respectively. The thicknesses of the change pieces are preferably the same as the thicknesses of the inner and outer boards. The widths $W_3$ of the change pieces are smaller than the widths of the inner and outer boards. The change pieces have two male interlocking joints carved from the top and bottom of the long ends of the pieces in the length $L_3$ direction. Change piece 18*a* has male interlocking joint ends 19*a* and 20*a* and change piece 18*b* has male interlocking joint ends 19*b* and 20*b*. A female interlocking joint 21*a* is routed along the entire length of an inner face of the change piece 18*a*, centrally located in the width $W_3$ direction. Change piece 18*b* has a similar female interlocking joint 21*b*. The change pieces 18*a* and 18*b* are more clearly seen in FIGS. 5 and 6.

Figure 1F:
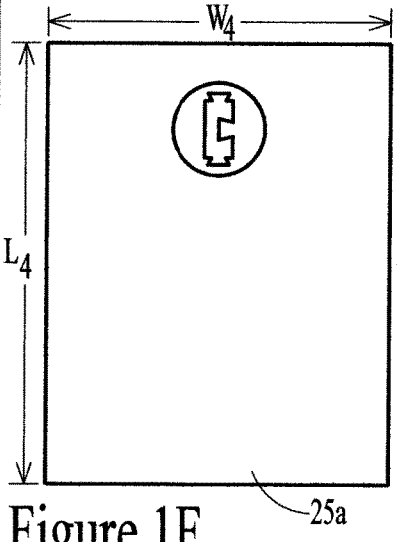
Figure 1G:
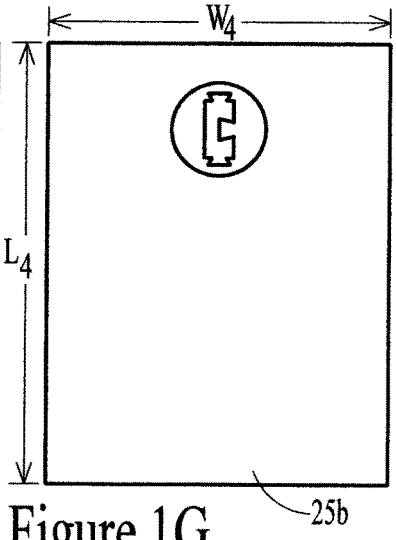
Figure 7:
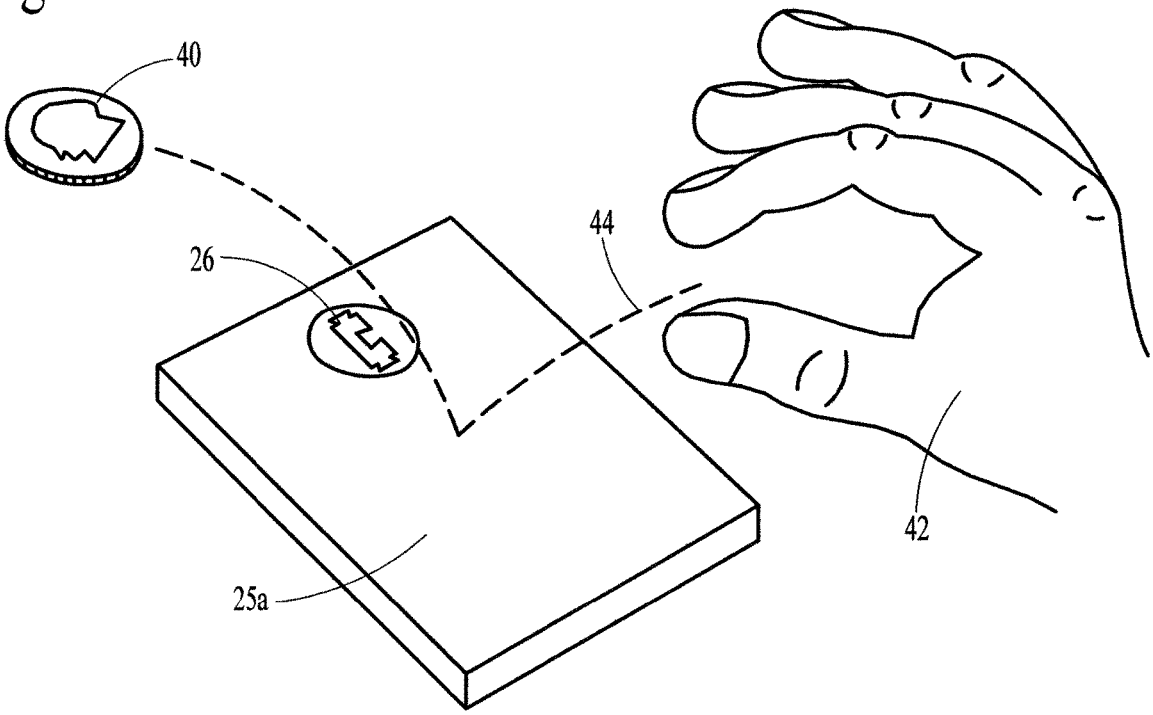
FIG. 7 illustrates the launch pad of the present disclosure.

Two launch pads 25*a* and 25*b*, shown in FIGS. 1F and 1G, respectively, are made from laminate, for example, or other appropriate material, and preferably printed with a logo 26 which is visible through the hole 30*a* in the outer board 12*a* when the game board pieces are arranged together for storage, as shown in FIG. 2. As shown in FIG. 7, a token or coin such as a quarter 40 can be launched by a user 42 and bounced on the launch pad 25*a*, as shown by the dotted line 44, aiming for one of the holes in the game board. Launch pads are not required and may not be desired If the playing piece is not configured to bounce, for example.

All pieces slide together into a compact set which allows for easy storage and portability. As shown in FIG. 2, outer boards 12*a* and 12*b* are joined together by the change pieces' 18*a* and 18*b* interlocking joints. The male interlocking joints 17*a* and 17*b* of Inner board 16 interlock with female interlocking joints 21*a* and 21*b*, respectively, of change pieces 18*a* and 18*b*. Launch pads 25*a* and 25*b* slide between outer board 12*a* and inner board 16 and between inner board 16 and outer board 12*b*. Game pieces such as quarters or other coins, tokens, or chips of a similar size, can be stored within the set between the launch pads 25*a* and 25*b* in the holes 32*a* and 32*b* of the inner board 16.

Four game arrangements are shown in FIGS. 3-6. Other arrangements could be made, as desired by a user. In the first game alternative shown in FIG. 3, change piece 18*a* is joined to outer board 12*a* through interlocking joints 19*a* and 14*a*, respectively. The other male interlocking joint 15*a* of change piece 18*a* rests on a surface such as a tabletop. The inner face of the outer board 12*a* at the non-joined end rests on the surface. Likewise, change piece 18*b* is joined to outer board 12*b* through interlocking joints 19*b* and 14*b*, respectively. The other male interlocking joint 15*b* of change piece 18*b* and the inner face of the non-joined end of the outer board 12*b* rest on the surface. Inner board 16 rests on the surface between and abutting the short ends of the two outer boards. For a single player game, a player would place one of the launch pads 25*a* or 25*b* at one of the two long sides of the configured game board 10 and launch coins, aiming for any of the holes 30*a*, 30*b*, 32*a*, and 32*b*. In a two-player game, the two launch pads 25*a* and 25*b* could be placed at opposite long ends of the game board and players could take turns launching coins toward the holes. Various scoring configurations could be anticipated.

Figure 4:
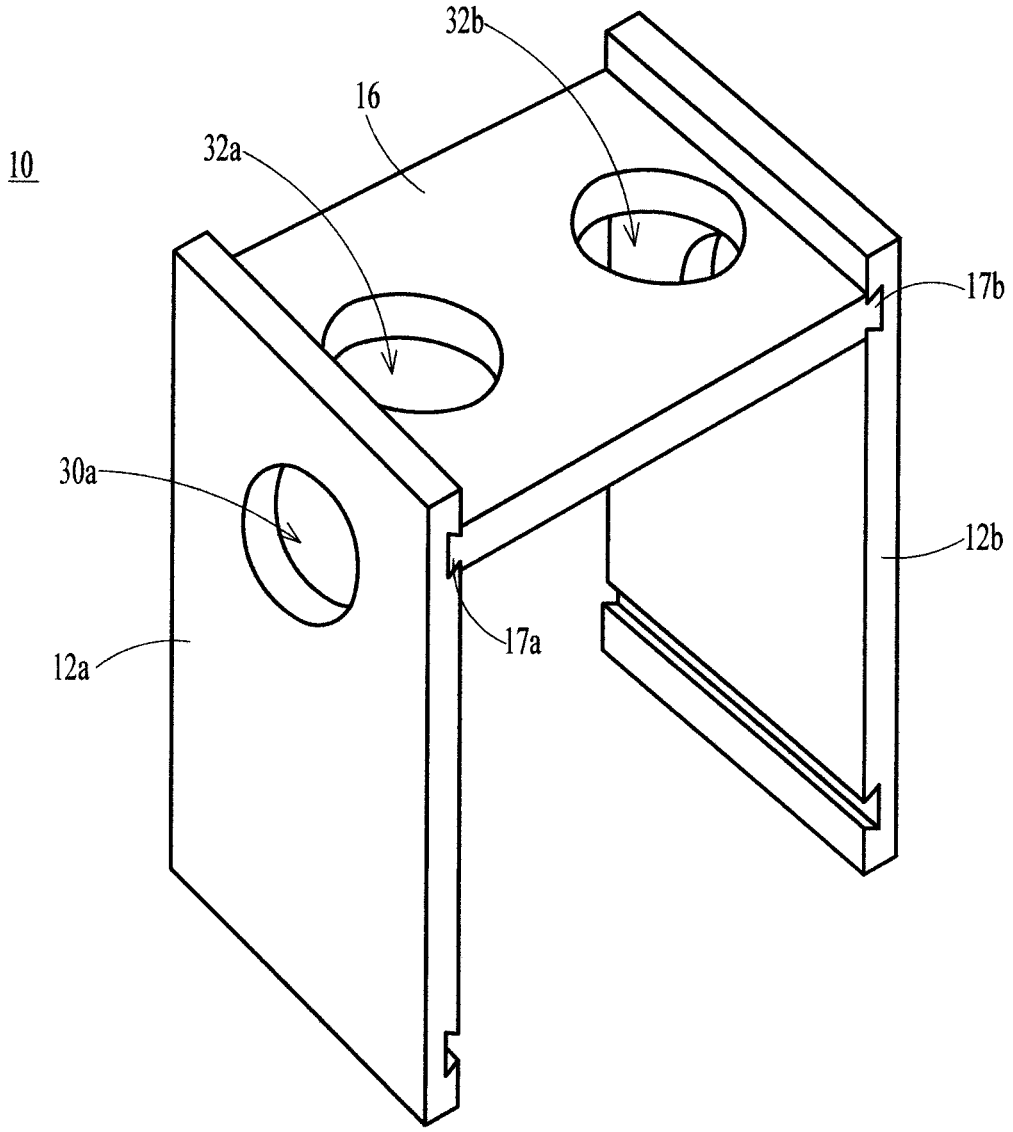

FIG. 4 illustrates a second sample game configuration. In this configuration, the inner board 16 is joined to the two outer boards 12*a* and 12*b* where the inner board's male interlocking joints 17*a* and 17*b* are joined with the female interlocking joints 14*a* and 14*b* of outer boards 12*a* and 12*b*, respectively. The short ends of the outer boards farthest from the inner board rest of the surface where the outer boards are vertically oriented and the inner board is horizontally oriented. As in the first game, launch pad(s) are placed on either side of the game board for play.

In the game configuration illustrated in FIG. 5, the two outer boards again each have one of their short ends resting on a surface. The two outer boards are joined together by the two change pieces interlocking their male interlocking joints 19*a* and 20*a* into female interlocking joints 14*a* and 14*b* on the outer boards 12*a* and 12*b*, respectively, and 19*b* and 20*b* into female interlocking joints 15*a* and 15*b* on the outer boards 12*a* and 12*b*, respectively. Next, one end male interlocking joint 17*b* of the inner board 16 is inserted into the female interlocking joint 21*a* of the topmost change piece 18*a*. From each side of the game board, a player sees a single hole 30*a* or 30*b* of the outer board 12*a* or 12*b* on the bottom of the board and double holes 32*a* and 32*b* at the top of the game board.

Figure 6:
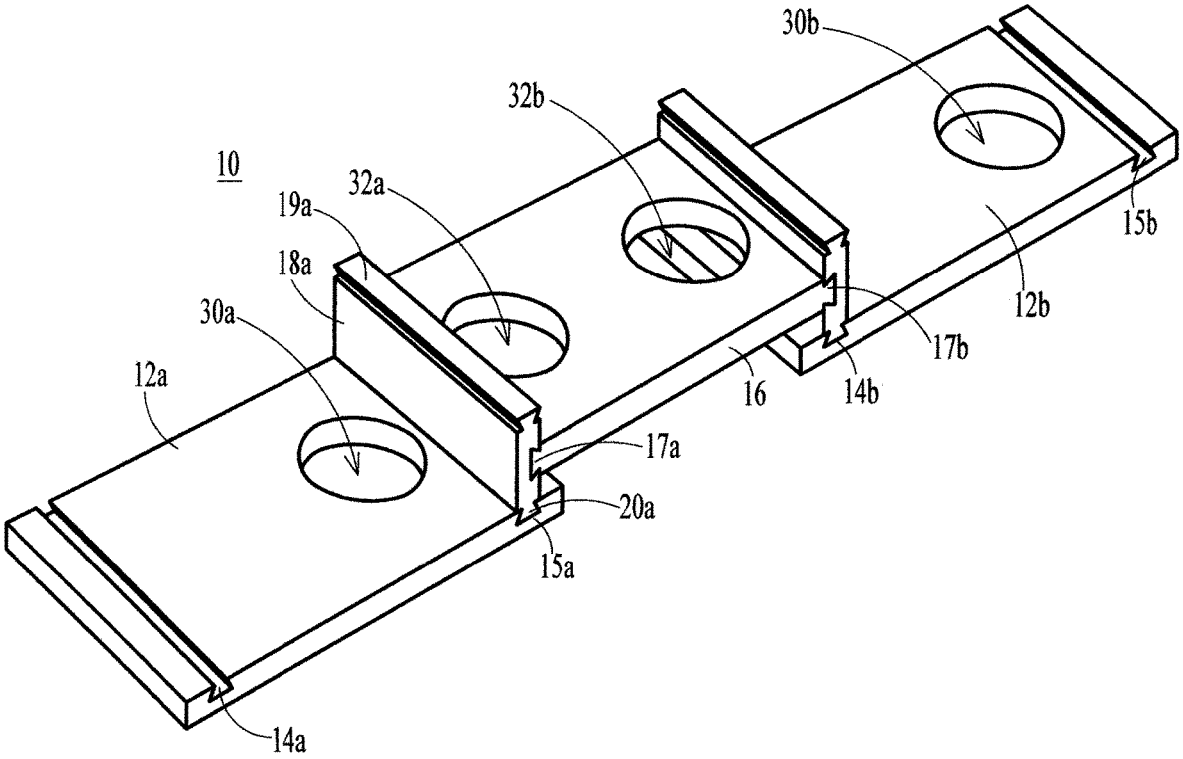

In the game configuration illustrated in FIG. 6, the outer board pieces 12*a* and 12*b* are laid on their outer faces end to end with a gap between them on the tabletop or other surface. One male interlocking end of a change piece 18*a* is inserted in the female interlocking joint 15*a* of outer board 12*a* closest to the other outer board 12*b*. The inner face of the change piece in which the female interlocking joint 21*a* lies faces the other board 12*b*. Similarly, one male interlocking end of the other change piece 18*b* is inserted in the female interlocking joint 15*b* of the other board 12*b* closest to the outer board 12*b*. The inner face of the change piece 18*b* in which the female interlocking joint 21*b* lies faces the other outer piece 12*a*. The inner board 16 interlocks with the two change pieces. The male interlocking ends 17*a* and 17*b* of the inner board 16 are slid into the facing female interlocking joints 21*a* and 21*b* of change pieces 18*a* and 18*b*, respectively.

It is anticipated that other game board configurations can be achieved by the re-configurable game board set of the present disclosure. The re-configurable game board set of the present disclosure can be used to play a variety of games in a variety of configurations and can be compacted for easy storage or transportation. The game board set can be of a size to easily fit on a tabletop and can use coins or similar tokens as playing pieces. Alternatively, the game board set could be larger to be played with larger playing pieces such as beanbags, balls, or discs. Games can be played with or without launching pads.

Although the preferred embodiment of the present disclosure has been illustrated, and that form has been described in detail, it will be readily understood by those skilled in the art that various modifications may be made therein without departing from the spirit of the disclosure or from the scope of the appended claims.

What is claimed is:

1. A re-configurable game board comprising:

first and second outer boards having a first length, a first width, and a first thickness wherein said first length is greater than said first width and said first thickness is smaller than said first width, each having an inner surface and an outer surface along said first length, having at least one first target circular hole through each of said outer boards and having two female interlocking joints in said inner surface of each of said first and second outer boards, one near each end of said first and second outer boards in said first length direction;

an inner board having a second length less than said first length, a second width equal to said first width, and a second thickness and having an inner surface and an outer surface along said second length, having at least one second circular target hole through said inner board, and having male interlocking joints are formed along both ends of said inner board along said second width; and first and second change pieces having a third length equal to said first width, a third width smaller than said first width, and a third thickness and having an inner surface and an outer surface along said first length, having male interlocking joints along both ends of said first and second change pieces in a direction of said third length, and having a female interlocking joint is in an inner surface of each of said first and second change pieces in a direction of said third length and centrally located with respect to a direction of said third width;

wherein said first and second outer pieces, said inner piece, and said first and second change pieces are configured to be joined together in a three-dimensional orientation by mating any of one or more of said female interlocking joints with any of said male interlocking joints and/or by abutting said inner piece between said first and second outer pieces in a direction of their first and second lengths to form a game board; and wherein any of said first or second target holes are configured to receive a playing piece launched toward said first or second target holes.

2. The game board according to claim 1 wherein said first and second outer boards, said inner board, and said first and second change pieces comprise wood, plastic, laminate, or resin.

3. The game board according to claim 1 further comprising two launching pads having a fourth length less than said first length, a fourth width equal to said first width, and a fourth thickness wherein said two launching pads are configured so that a said playing piece will bounce on said launching pads when launched toward said first or second target holes.

4. The game board according to claim 3 wherein said two launching pads comprise wood, plastic, laminate, resin, or rubber.

5. The game board according to claim 3 wherein said first and second outer boards, said inner board, said first and second change pieces, and said two launching pads are configured to be slid together for storage to form a compact shape having said first length and said first width and wherein said game board is configured hold at least one said playing piece within said at least one second circular hole and between said two launching pads when said game board is in said compact shape.

6. The game board according to claim 1 wherein said first and second outer boards, said inner board, and said first and second change pieces are configured to be slid together for storage to form a compact shape having said first length and said first width.

7. The game board according to claim 1 wherein said first and second outer boards, said inner board, and said first and second change pieces are configured to be joined together in a variety of ways through interlocking joints to form a variety of difference game board configurations.

8. The game board according to claim 1 wherein said at least one first circular target hole is centered in said first width direction and located within a first half of each of said outer boards in said first length direction.

9. The game board according to claim 1 wherein said at least one second circular target hole is centered in said second width direction.

10. The game board according to claim 1 wherein two second target circular holes are formed in said outer surface of said inner board centered in said second width direction and evenly spaced in said second length direction.

11. The game board according to claim 1 wherein said first, second, and third thicknesses are the same.

12. The game board according to claim 1 wherein said first and second outer pieces, said inner piece, and said first and second change pieces are configured to be joined together in said three-dimensional orientation by:

placing said inner surface of said inner piece on a horizontal surface;

abutting said first outer piece to a first end of said inner piece in said first and second length directions and abutting said second outer piece to a second end of said inner piece in said first and second length directions wherein said first and second outer pieces lie on their inner surfaces; and joining a first male interlocking joint of said first change piece to a female interlocking joint of said first outer board furthest from said inner board and resting a second male interlocking joint of said first change piece on said horizontal surface and joining a first male interlocking joint of said second change piece to a female interlocking joint of said second outer board furthest from said inner board and resting a second male interlocking joint of said second change piece on said horizontal surface to form a three-dimensional game board wherein playing pieces are configured to be launched into any one of said first or second circular target holes.

13. The game board according to claim 1 wherein said first and second outer pieces and said inner piece are configured to be joined together in said three-dimensional orientation by:

joining a first male interlocking joint of said inner board to a female interlocking joint of said first outer board and joining a first male interlocking joint of said second inner board to a female interlocking joint of said second outer board to create a U-shaped three-dimensional game board; and resting short ends of said first and second outer boards farthest from said inner board on a horizontal surface wherein playing pieces are configured to be launched into any one of said first or second circular target holes.

14. The game board according to claim 1 wherein said first and second outer pieces, said inner piece, and said first and second change pieces are configured to be joined together in said three-dimensional orientation by:

joining a first male interlocking joint of said first change piece to a first female interlocking joint of said first outer board and joining a second male interlocking joint of said first change piece to a first female interlocking joint of said second outer board and joining a first male interlocking joint of said second change piece to a second female interlocking joint of said first outer board and joining a second male interlocking joint of said second change piece to a second female interlocking joint of said second outer board;

resting first short ends of joined said first and second outer boards on a horizontal surface wherein said female interlocking joint of uppermost of said first or second change piece is facing upwards; and joining a first male interlocking joint of said inner board to said upwards facing female interlocking joint of said first or second change piece wherein playing pieces are configured to be launched into any one of said first or second circular target holes.

15. The game board according to claim 1 wherein said first and second outer pieces, said inner piece, and said first and second change pieces are configured to be joined together in said three-dimensional orientation by:

joining a first male interlocking joint of said inner piece to said female interlocking joint of said first change piece and joining a second male interlocking joint of said inner piece to said female interlocking joint of said second change piece;

joining a first male interlocking joint of said first change piece to a female interlocking joint of said first outer board closest to said inner board and resting said outer surface of said first outer board on a horizontal surface; and joining a first male interlocking joint of said second change piece to a female interlocking joint of said second outer board closest to said inner board and resting said outer surface of said second outer board on said horizontal surface to form a three-dimensional game board wherein playing pieces are configured to be launched into any one of said first or second circular target holes.

* * * * *